US005362212A

United States Patent [19]

Bowen et al.

[11] Patent Number: 5,362,212

[45] Date of Patent: Nov. 8, 1994

[54] AIR DRIVEN DIAPHRAGM PUMP

[75] Inventors: Robert J. Bowen, Moreno Valley, Calif.; Craig Q. Davis, Evanston, Ill.

[73] Assignee: Wilden Pump & Engineering Co., Colton, Calif.

[21] Appl. No.: 208,492

[22] Filed: Mar. 9, 1994

Related U.S. Application Data

[63] Continuation of Ser. No. 54,633, Apr. 29, 1993, abandoned.

[51] Int. Cl.[5] ..... F04B 39/10

[52] U.S. Cl. ..... 417/395; 417/393; 417/397

[58] Field of Search ..... 417/393, 395, 397

[56] References Cited

U.S. PATENT DOCUMENTS 4,549,647 10/1985 Wilder et al. ..... 417/393 X

*Primary Examiner*—Richard E. Gluck

*Attorney, Agent, or Firm*—Lyon & Lyon

[57] ABSTRACT

An air driven diaphragm pump having two diaphragms joined by a common control shaft to reciprocate in opposed chambers for pumping material through check valve ported cavities. An actuator valve is associated with the central housing of the pump and includes a valve cylinder within which a valve piston reciprocates. The valve piston is caused to reciprocate by alternate venting of the ends of the cylinder. Enlarged air chamber passages are controlled by the control shaft to vent the ends of the valve cylinder. A cylindrical portion of the control shaft includes axial slots for venting alternate ends of the valve piston. Annular channels manifold air to and from the axial slots.

7 Claims, 3 Drawing Sheets

AIR DRIVEN DIAPHRAGM PUMP

This application is a continuation of U.S. patent application Ser. No. 08/054,633, filed Apr. 29, 1993, now abandoned.

BACKGROUND OF THE INVENTION

The field of the present invention is control of air driven diaphragm pumps.

Pumps having double diaphragms driven by compressed air directed through an actuator valve are well known. Reference is made to U.S. Pat. Nos. 5,169,296; 4,247,264; 294,946; 294,947; and 275,858, all issued to James K. Wilden, the disclosures of which are incorporated herein by reference. An actuator valve operated on a feedback control system is disclosed in U.S. Pat. No. 3,071,118 issued to James K. Wilden, the disclosure of which is also incorporated herein by reference. This feedback control system has been employed with the double diaphragm pumps illustrated in the other patents.

Such pumps include an air chamber housing having a center section and two concave discs facing outwardly from the center section. Opposing the two concave discs are pump chamber housings. The pump chamber housings are coupled with an inlet manifold and an outlet manifold through ball check valves positioned in the inlet passageways and outlet passageways from and to the inlet and outlet manifolds, respectively. Diaphragms extend outwardly to mating surfaces between the concave discs and the pump chamber housings. The diaphragms with the concave discs and with the pump chamber housings each define an air chamber and a pump chamber to either side thereof. At the centers thereof, the diaphragms are fixed to a control shaft which slidably extends through the air chamber housing.

Actuator valves associated with such pumps have included feedback control mechanisms including a valve piston and airways on the control shaft attached to the diaphragms. Air pressure is alternately generated in each air chamber according to control shaft location, driving the diaphragms back and forth. In turn, the pump chambers alternately expand and contract to pump material therethrough. Such pumps are capable of pumping a wide variety of materials of widely varying consistency.

FIGS. 1 and 2 illustrate a previously designed control rod or shaft and associated bushing, respectively. The shaft PA1 has a center portion having a waist PA2 of reduced cross-sectional dimension in the otherwise cylindrical shaft PA1. Axial slots are equiangularly spaced about the waist PA2 to provide added axial air flow. The associated bushing PA3 has three annular channels to either side of a central portion. The innermost and outermost channels PA4 and PA5 of each set of three receive O-rings to act as annular seals between the bushing PA3 and the shaft PA1 in order that flow may be controlled between the central annular channels PA6 and vent passages PA7.

The valving mechanism provided by the shaft PA1 and the bushing PA3 cooperates with a control valve to alternately vent either end of a shuttle piston at the ends of the stroke of the shaft PA1. The venting occurs when the waist portion PA2 spans alternately the two innermost channels PA4 to expose the central annular channels PA6 to the vent passages PA7. The waist portion PA2 provides both an axial passage capable of spanning the aforementioned seals and a circular manifold for venting annular air flow across the seal to the vent passages PA7 at either side. This arrangement has long been employed because of the need to rapidly vent the appropriate passage of the control valve. By using the waist PA2 with a conical transition surface, the O-ring associated with the seal is caused by relative pressure differential across the seal to deform and remain in contact with the surface of the conical portion of the waist PA2 until it finally overcomes that pressure differential and pops back to an undeformed state. In doing so, it instantaneously opens a substantial cross-sectional area between the O-ring and the conical portion of the waist PA2. This action results in the area between the O-ring and the waist portion PA2 not being the area of greatest flow resistance at the moment of opening. The vented air may then pass around the waist PA2 to a vent passage PA7. The venting of one passage from the associated control valve causes the shuttle piston therein to be drawn to the vented end. It has been found necessary to insure rapid movement of that piston so as to prevent a condition of stall. This configuration of the shaft PA2 in other than a fully cylindrical shape has resulted in excessive O-ring wear and the need for O-rings of high shore hardness.

SUMMARY OF THE INVENTION

The present invention is directed to an air driven diaphragm pump employing a cylindrical portion having axial slots cooperating with two annular channels to shift a control valve directing air to the pump and in communication with one of the channels by venting air through communication of the two channels. The use of a cylindrical section and of a venting channel provides sufficient passage of air for rapid shifting of the control valve and reduces wear to any seal located between the annular channels. Accordingly, it is an object of the present invention to provide an improved air driven diaphragm pump having accurate shifting capabilities and significant seal longevity.

DETAILED DESCRIPTION OF THE PREFERRED EMBODIMENT

Figure 1:
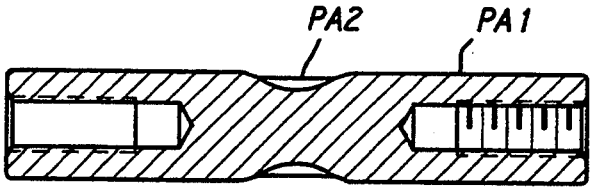
FIG. 1. (PRIOR ART)
FIG. 1 is a cross-sectional view of a prior art shaft.
Figure 2:
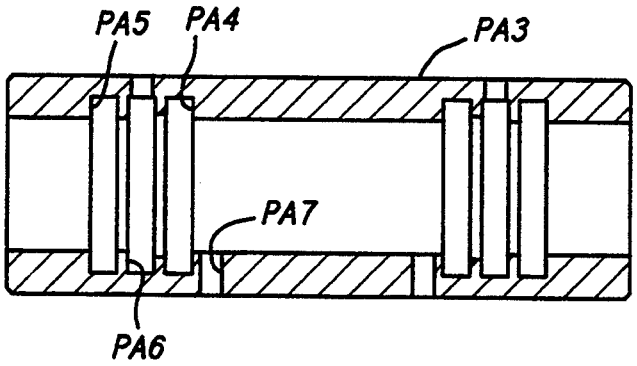
FIG. 2. (PRIOR ART)
FIG. 2 is a cross-sectional view of a prior art bushing.
Figure 5:
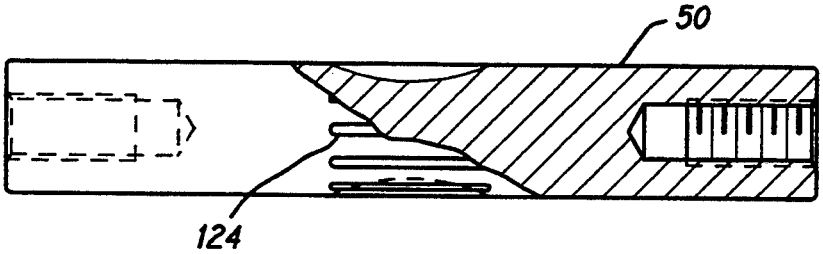
FIG. 5 is a cross-sectional view of a shaft of the present invention.
Figure 6:
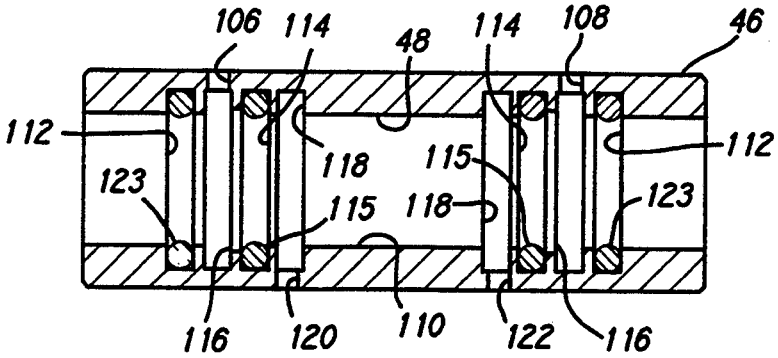
FIG. 6 is a cross-sectional view of a bushing of the present invention.

Turning in detail to the drawings, FIGS. 1 and 2 represent prior art devices. FIGS. 3 through 6 illustrate a preferred embodiment of the present invention. The air driven double diaphragm pump is illustrated in central cross section in FIG. 3 as including two water chamber housings 10 and 12. The water chamber housings 10 and 12 are identical and each includes an inlet passage 14, an outlet passage 16, an inlet ball check valve 18 associated with a valve seat 20 and an outlet ball check valve 22 associated with a valve seat 24. A central cavity 26 is associated with a diaphragm to define a variable volume pump chamber in communication through the valves 18 and 22 with the inlet 14 and outlet 16, respectively. Associated with the two inlets 14 of the water chamber housings 10 and 12 is an inlet T 28 having an internally threaded inlet port 30 for receipt of a suction hose or the like. Similarly arranged with the outlet passages 16 is an outlet T 32 which includes a similar port 34 for coupling with a discharge hose or the like.

Centrally located between the water chamber housings 10 and 12 is an actuator housing, generally designated 34. The actuator housing integrally includes a control shaft housing 36 located between air chamber members 38 and 40. The air chamber members 38 and 40 each define variable volume air chambers 42 and 44 with an associated diaphragm. The center section forming the control shaft housing 36 includes a hole extending therethrough to receive a bushing 46.

Extending through the bushing 46 is a control passageway 48 which receives a control shaft 50. The control shaft 50 has an axial passage, discussed in greater detail below, centrally located therein. At its outer ends, the control shaft 50 includes threaded end portions for the receipt of identical locking bolts 54 which hold mounting flanges 56 and 58 in position. Between the mounting flanges 56 and 58 at each end of the control shaft 50 are mounted flexible diaphragms 60. One such diaphragm is illustrated in U.S. Pat. No. 4,238,992 to Tuck, Jr., the disclosure of which is incorporated herein by reference. About the outer periphery of each of the flexible diaphragms 60 is a circular bead 62. The circular bead 62 is positioned in circular recesses located on each of the water chamber housings 10 and 12 and the air chamber members 38 and 40 of the actuator housing 34. Clamp bands 64 retain the diaphragms 60, the water chamber housings 10 and 12 and the actuator housing 34 in assembly.

The air driven double diaphragm pump is driven by pressurized air alternately being charged to and vented from each of the variable volume air chambers 42 and 44. Assuming the operating condition that the control shaft 50 is moving to the left in FIG. 3, the air chamber 42 would be in communication with the source of pressurized air while the air chamber 44 would be venting to atmosphere. This differential pressure operating on the diaphragms 60 forces the diaphragms 60 and in turn the control shaft 50 to move to the left. In doing so, the central cavity 26 in the water chamber housing 10 is being reduced by the displacement of the left diaphragm 60. At the same time, the central cavity 26 associated with the water chamber housing 12 is expanding. Thus, the water chamber housing 10 is experiencing an exhaust stroke while the water chamber housing 12 is experiencing a suction stroke. In the suction stroke, the ball valve 18 admits material to be pumped from the inlet passage 14. At the same time, the outlet ball valve 22 is seated to insure proper suction. In the exhaust stroke, the ball valve 18 is seated while the ball valve 22 is lifted for discharge of material within the central cavity 26. Through continued reciprocation of the diaphragms 60 and the control shaft 50, the two central chambers 26 alternately draw material to be pumped into the chamber and exhaust same. This type of pump has the capacity for pumping a wide variety of materials of widely varying viscosities and amounts of entrained solids.

To provide the alternating pressurized air and venting to the pump, an actuator valve is employed. The actuator valve is defined within an actuator housing which includes a valve housing 66 and the actuator housing 34. The valve housing 66 includes a generally cylindrical body having a mounting flange 68. The housing 66 is securely fastened to the front wall of the actuator housing 34 by fasteners. The housing 66 includes a valve cylinder 72. The valve cylinder is closed at each end by plugs 74 and 76 retained by spring clip 78. The spring clips 78 are set within grooves designed for this purpose. The plugs 74 and 76 include sealing O-rings positioned in peripheral grooves about each plug. An inlet 80 extends to the center of the valve cylinder 72 and is internally threaded for receipt of a shop air hose or the like. One of the plugs 76 includes a pin 82 extending into the main portion of the valve cylinder 72 for alignment purposes.

Located within the valve cylinder 72 is a valve piston 84. The valve piston 84 is arranged to slide within the cylinder 72 such that the piston 84 is capable of stroking back and forth from end to end within the cylinder. The piston 84 includes spacers 86 on either end thereof. These spacers 86 each define an annular cavity between the end of the piston 84 abutting against a plug 74, 76. The body of the valve piston 84 is sized such that clearance is provided between the wall of the cylinder 72 and the valve piston 84 to provide means for continuously directing air to the ends of the cylinder. The clearance is such that this flow of air axially between the piston 84 and the wall of the cylinder 72 is restricted. Pressure is accumulated over a short period of time prior to the next piston stroke but cannot flow so quickly as to prevent substantial venting of the cylinder at one or the other of the ends of the piston 84.

Longitudinal passages 88 extend from the near midpoint of the piston 84 to either end. Associated with these longitudinal passages 88 are pinholes 90 such that a volume of incoming air through the inlet 80 may be directed through one or the other of the pinholes 90 and the associated passage 88 to an end of the cylinder 72. Thus, only one of the pinholes 90 is ever exposed to the inlet 80 at a time such that incoming air is able to flow through only one of the pinholes 90 at a time when positioned in communication with the inlet 80 during a portion of the stroke. This arrangement enhances shifting as will be discussed below. Conveniently, the pin 82 is sized and positioned within one of the longitudinal passages 88 to allow free air flow thereabout.

Located in an annular groove about the center of the valve piston 84 is an inlet passage 92. The width of the inlet 80 at the cylinder 72 is such that the inlet passage 92 is always exposed to the inlet. Thus, a constant source of air is provided to a location diametrically opposed to the inlet 80 across the piston 84. Located on the side of the piston 84 on the other side from the inlet 80 are two valve passages 94 and 96. These valve passages 94 and 96 extend axially along the piston 84 and are mutually spaced to either side of the inlet passage 92. In the preferred embodiment, these valve passages 94 and 96 are channels.

Defined within the cylinder 72 diametrically across from the air inlet 80 are two air chamber passages 98 and 100 and two exhaust ports 102 and 104. The air chamber passages 98 and 100 and the exhaust ports 102 and 104 extend through the valve housing 66 and through the actuator housing 34. The air chamber passages 98 and 100, the exhaust ports 102 and 104 and the end of the inlet passage 92 are axially aligned along the cylinder 72. As can best be seen in FIG. 4, the longitudinal passages 94 and 96 are able to selectively span across from one air chamber passage 98, 100 to an exhaust port 102, 104. Further, the air chamber passages 98 and 100 are arranged such that the inlet passage 92 is aligned with one or the other of these with the valve piston 84 located at one or the other of the ends of its stroke. Thus, at one end of the stroke of the piston 84, the inlet passage 92 is in communication with the air chamber passage 98 and the valve passage 96 is in communication at its ends with the air chamber passage 100 and the exhaust port 104. The valve passage 94 is in communication with the exhaust port 102 to no effect. The air chamber passages 98 and 100 each extend to one of the variable volume air chambers 42 and 44. Consequently, one air chamber is pressurized by being in communication with the inlet passage 92 through the air chamber passage 98 while the other air chamber is exhausted through the air chamber passage 100, the valve passage 96 and the exhaust port 104. By shifting the valve 84, the process is reversed.

Extending from adjacent each end of the valve chamber 72, shift passages 106 and 108 are arranged for controlling the valve piston 84. These shift passages 106 and 108 extend through the valve housing 66 and the actuator housing 34. Each shift passage 106 and 108 is defined by two passageways which are mutually displaced one from another in the valve housing 66 and are located adjacent an end of the valve cylinder 72 at the plugs 74 and 76. The passageways of the shift passages 106 and 108 are joined in the control shaft housing 36.

The bushing 46 includes four annular channels about the control passageway 48 to either side of a central bearing surface 110. In each set of four annular channels, there are two sealing channels 112 and 114 which retain O-rings 115 and 123 to form annular seals about the control shaft 50. Between the two sealing channels 112 and 114 on either end of the bushing 46, annular channels 116 communicate with shift passages 106 and 108, respectively. Inwardly of the sealing channels 114 is an annular channel 118 on either end of the bushing. These annular channels 118 are in communication with vent passages 120 and 122 which vent to atmosphere. Thus, when communication is created between either one of the annular channels 116 and an annular channel 118, a shift chamber at either end of the piston 84 is vented to shift the piston to the other end of the valve cylinder 72. This shifting occurs because of the differential pressure between the vented end and the unvented end of the piston 84 where pressure has accumulated.

To provide communication selectively between sets of annular channels 116 and 118 for shifting the piston 84, the control shaft 50 includes a central cylindrical portion having axial slots 124. The axial slots 124 are mutually angularly spaced apart and are located at a common axial position along the control shaft 50 and are also of common extent such that they act uniformly across the seal in annular channel 114, and connect the two shifting channels 116 and 118. Any number of such channels may be provided and are most appropriately equiangularly placed. The central cylindrical portion of the control shaft 50 is fully cylindrical, including between axial slots 124. This provides a uniform cylindrical surface upon which the annular seals defined by the O-rings 115 and 123 slide. By having the axial slots 124 associate with both an annular channel 116 to manifold venting air to the slots and the annular channel 118 to manifold air from the slots 124 to atmosphere, sufficient air flow is achieved to allow shifting of the piston 84 without substantial resistance. Free shifting is helpful to avoid the possibility of stalling the piston between positions. The cylindrical nature of the central portion of the control shaft 50 provides for O-ring longevity and permits the use of relatively soft O-ring material, 70 shore.

Figure 3:
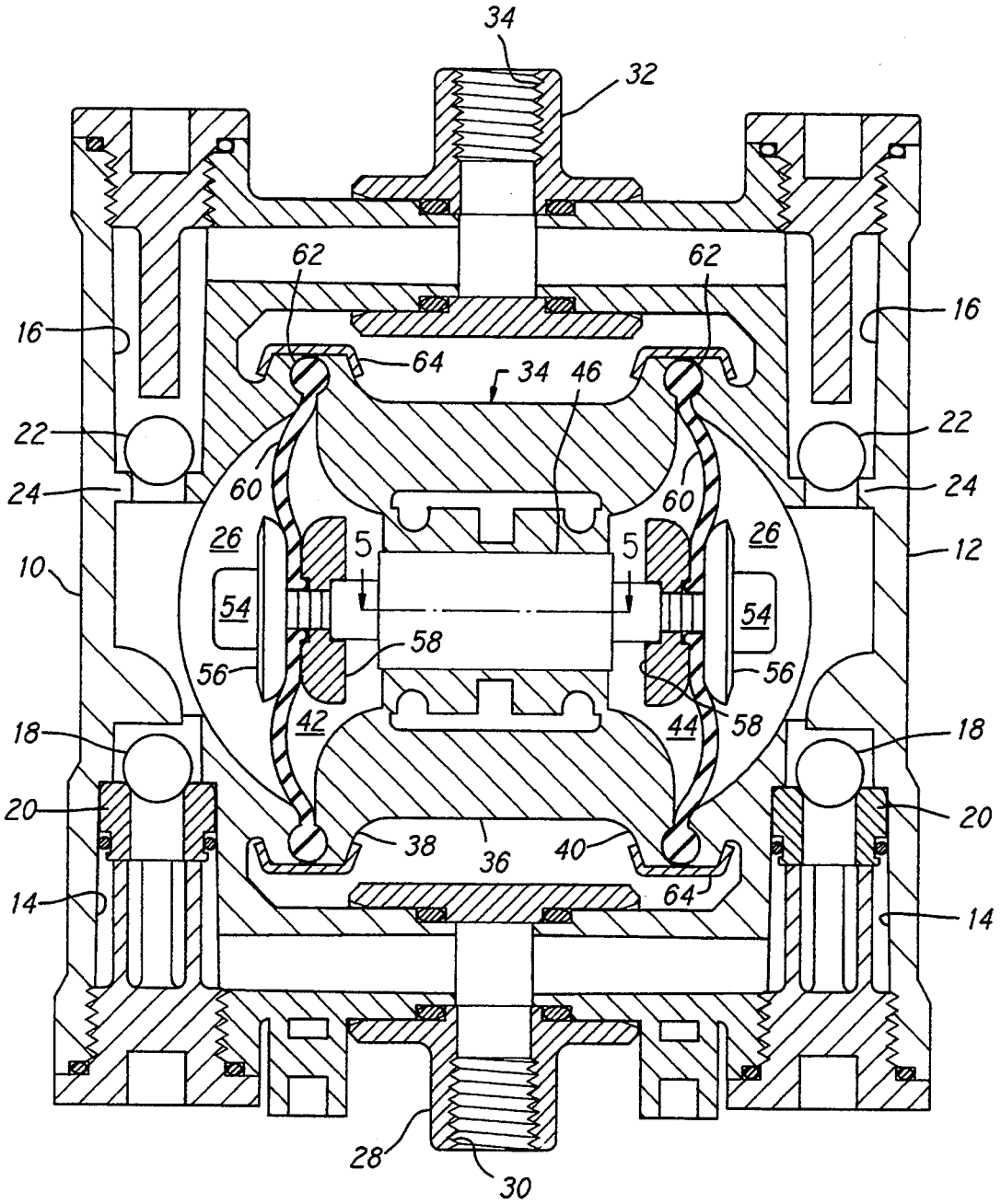
FIG. 3 is a cross-sectional view of an air driven diaphragm pump incorporating the present invention.
Figure 4:
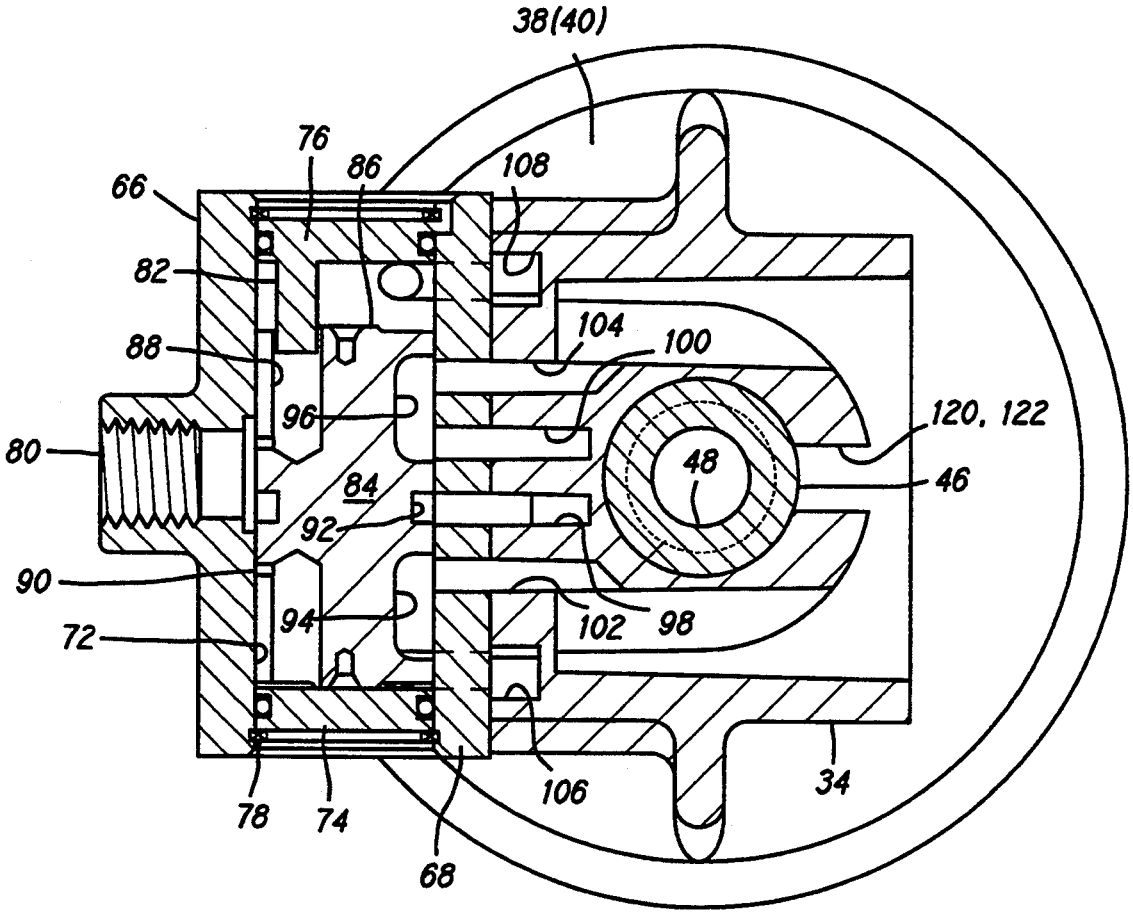
FIG. 4 is a cross-sectional view of an actuator valve associated with an air driven diaphragm pump.

In operation, pressurized air is provided to the inlet 80. Normally the valve piston 84 is found in its lower position due to gravity prior to activation of the pump. Such a position of starting is illustrated in FIG. 4. Both ends of the valve cylinder 72 are pressurized, either through the passageways or through the tolerance about the valve piston 84. Pressurized air is also conveyed through the inlet passage 92 to the air chamber passage 98. Air is directed through the passage 98 to the variable volume chamber 44 to force the diaphragm 60 further into the central cavity 26 to the right as seen in FIG. 3. Thus, pumping action is initiated with a pressure stroke on the right and a suction stroke on the left as seen in FIG. 3. When the control shaft 50 advances to the point that the axial slots 124 span the O-ring 115, the shift passage 108 communicates with the vent through passage 122. Once such communication is established, the cavity at the upper end of the valve cylinder 72 is vented and the compressed air at the other end of the valve cylinder 72 drives the piston 84 upwardly to the other end of its stroke. Venting through the shift passage 108 must exceed the flow through the upper pinhole 90 and the flow around the piston 84 through the clearance with the cylinder 72. In this way, pressure is reduced at the upper end of the cylinder and the pressure remaining at the closed end of the cylinder is able to force the piston through its stroke. Once it reaches just past midstroke, the lower pinhole 90 further contributes air to the lower, closed end of the valve cylinder 72. Once shifted, air to and from the double diaphragm pump is reversed. Incoming air now is directed through the inlet passage 92 to the air chamber passage 100 which is directed to the variable volume air chamber 42 on the left side of the pump as seen in FIG. 3. Thus, the left central cavity experiences a pressure stroke while the right central cavity experiences a vacuum stroke. Eventually the control shaft 50 proceeds such that the axial slots 124 span the O-ring 115 and the cycle is then repeated. Venting of the ends of the valve chamber are enhanced with increased flow for shifting.

Accordingly, an improved feedback control system for actuating an air driven diaphragm pump is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven diaphragm pump comprising a diaphragm;

a pump chamber to one side of said diaphragm;

an air chamber to the other side of said diaphragm;

a controlled inlet passage to said pump chamber;

a controlled outlet passage from said pump chamber;

a bushing having a passageway therethrough and annular channels within said passageway;

a control valve including a cylinder, a piston slidable within said cylinder, and a passage between said valve and a first said channel;

an inlet communicating with the middle of said cylinder, said piston including restricted flow paths from the middle of said cylinder to the ends of said piston;

a vent passage extending from a second said channel to atmosphere;

a shaft fixed to said diaphragm and including a cylindrical portion slidably extending through said passageway, extending across and longitudinally outwardly of said first and said second channels throughout the full stroke of said diaphragm, and having axial slots mutually angularly spaced, of mutually common axial placement and extent, significantly less restricted to flow than said flow paths and selectively extending between said first said channel and said second said channel.

2. The air driven diaphragm pump of claim 1 wherein said bushing further includes an annular seal between said first said channel and said second said channel.

3. The air driven diaphragm pump of claim 1 wherein said slots are equiangularly spaced about said shaft.

4. An air driven diaphgram pump comprising a diaphragm;

a pump chamber to one side of said diaphragm;

an air chamber to the other side of said diaphragm;

a controlled inlet passage to said pump chamber;

a controlled outlet passage from said pump chamber;

a bushing having a passageway therethrough and annular inlet channels within said passageway;

a control valve including a cylinder, a piston slidable within said cylinder, and first and second passages between said valve at either end of said cylinder and first and second said channels, respectively;

an inlet communicating with the middle of said cylinder, said piston including restricted flow paths from the middle of said cylinder to the ends of said piston;

an annular vent extending from said passageway to atmosphere;

a shaft fixed to said diaphragm and including a cylindrical portion slidably extending through said passageway, extending across and longitudinally outwardly of said first and said second channels throughout the full stroke of said diaphgram, and having axial slots mutually angularly spaced, of mutually common axial placement and extent, significantly less restricted to flow than said flow paths and selectively extending between either of said first and second said channels and said vent.

5. The air driven diaphragm pump of claim 4 wherein said vent includes third and fourth annular channels each extending from said passageway to atmosphere.

6. The air driven diaphragm pump of claim 4 wherein said bushing further includes annular seals between said first and second said channels and said vent, respectively.

7. The air driven diaphragm pump of claim 4 wherein said slots are equiangularly spaced about said shaft.

* * * * *